US005245706A

United States Patent [19]

Moschetti et al.

[11] Patent Number: 5,245,706

[45] Date of Patent: Sep. 21, 1993

[54] CHEST PROTECTOR

[76] Inventors: Mitchell R. Moschetti, 1250 S. Corona; Jeffrey J. Smith, 3353 S. Monaco St., both of Denver, Colo. 80210

[21] Appl. No.: 937,056

[22] Filed: Aug. 26, 1992

[51] Int. Cl.[5] ..... A41D 13/00

[52] U.S. Cl. ..... 2/2; 2/2.5; 2/51; 2/45

[58] Field of Search ..... 2/2, 2.5, 51, 44, 45; 128/78, 82, 87 B, 869, 870, 874, 875

[56] References Cited

U.S. PATENT DOCUMENTS

| | | | |
|---|---|---|---|
| 690,140 | 12/1901 | Gamble | 2/2 |
| 1,385,371 | 7/1921 | Fraser | 2/2.5 |
| 2,250,267 | 7/1941 | Lins | 2/44 |
| 2,252,357 | 8/1941 | Shaw | 128/875 |
| 2,255,464 | 9/1941 | Hall, Jr. | 2/44 |
| 2,468,841 | 5/1949 | Siegel | 2/2 |
| 3,135,961 | 6/1964 | Roderick | 2/2 |
| 3,162,861 | 12/1964 | Gustafson | 2/2 |
| 3,873,998 | 4/1975 | Norris et al. | 2/2.5 |
| 3,945,041 | 3/1976 | Rhee | 2/2 |
| 4,272,847 | 6/1981 | Buhler | 2/2 |
| 4,287,607 | 9/1981 | Leach | 2/2.5 |
| 4,317,237 | 3/1982 | Porte | 2/2 |
| 4,397,636 | 8/1983 | Ganshaw | 2/2 |
| 4,413,357 | 11/1983 | Sacks | 2/2.5 |
| 5,106,331 | 4/1992 | Lizarazu | 2/2 |

FOREIGN PATENT DOCUMENTS

| | | | |
|---|---|---|---|
| 124411 | 5/1947 | Australia | 2/2 |

*Primary Examiner*—Clifford D. Crowder
*Assistant Examiner*—Gloria Hale

[57] ABSTRACT

The present invention relates to a protective device for the chest for use in athletic activities such as baseball, softball and hockey. The present invention provides a protective body or plate for the center of the chest and includes a first lobe which extends vertically along the mid portion of the sternum, second and third lobes which respectively extends along the right and left lower portion of the rib cage adjacent to the sternum, and a fourth lobe which extends downward over the solar plexus of the user. The protective plate is also provided with a domed profile which assists in maintaining the proper positioning of the plate and in absorbing and dissipating impact energy.

11 Claims, 5 Drawing Sheets

CHEST PROTECTOR

BACKGROUND OF THE INVENTION

1. Field of the Invention

The present invention relates to a protective device for participants in sporting events, and more particularly, to a protective device for the chest.

2. Description of the Prior Art

In sporting and other activities, participants are sometimes injured when struck in the chest, as by projectiles such as baseballs, softballs or hockey pucks. One area particularly prone to injury has been the chest. Participants have been known to suffer shortness of breath, broken sternum or ribs, and even cardiac arrest, when impacted in the chest. Children appear to be at greater risk due to their smaller size and stature and lack of physical development.

In the past, protective equipment for the chest has typically been made in the form of a vest or apron configuration which covers almost the entirety of the chest. Such designs are disadvantageous for several reasons. First, they tend to be bulky or confining and therefore restrict the natural athletic motion of the wearers. Second, they tend to be hot and uncomfortable to wear because they restrict airflow. And third, they tend to be expensive.

SUMMARY OF THE INVENTION

The present invention relates to a protective device for the chest specifically designed to protect against impacts which occur near the center and lower portion of the chest near the sternum and "solar plexus" area.

In its preferred embodiment, the protective body or plate of the present invention includes a first lobe which extends vertically along the mid portion of the sternum, second and third lobes which respectively extends along the right and left lower portion of the rib cage adjacent to the sternum, and a fourth lobe which extends downward over the solar plexus of the user. The protective plate is also provided with a domed profile which assists in maintaining the proper positioning of the plate and in absorbing and dissipating impact energy.

The present invention is advantageous because it is smaller, lighter and less restrictive than conventional chest protectors. It is also not as hot or uncomfortable to wear, and can be manufactured less expensively than conventional chest protectors.

BRIEF DESCRIPTION OF THE DRAWINGS

In the description which follows, an illustrative embodiment of the present invention is explained in detail with the aid of drawings in which.

DETAILED DESCRIPTION OF THE PREFERRED EMBODIMENT

For the purposes of illustration only, the present invention is described in terms of its preferred physical embodiment. It will be apparent to those skilled in the art that the present invention is not limited in scope to the preferred physical embodiment, but rather is adaptable to numerous other embodiments. Similarly, various modifications and improvements may be made to the present invention as it relates to the preferred physical embodiment and other alternate embodiments without departing from the scope and spirit of the invention. Accordingly, the present invention is limited only by the scope of the appended claims.

The present invention is adaptable to a vast number of applications. For the purpose of illustration only, the present invention will hereinafter be described with respect to its best mode. It should be well understood, however, that the present invention is not limited to this specific application or embodiment.

The present invention relates to a device designed to protect the chest, such as from impacts that commonly occur from baseballs, softballs, hockey pucks and the like. The present invention is specifically designed to protect against injuries from impacts that occur near the lower middle part of the chest near the sternum and "solar plexus." The protective device of the present invention redistributes the impact force over a larger area of the mid part of the sternum and the lower ribs of the user compared to the situation where the protective device is not used. The present invention is also less confining and allows the user a more normal range of motion than conventional chest protectors, and has the additional benefit of restricting less airflow, thereby making it cooler to wear than conventional devices.

While the present invention is particularly useful in a large number of sporting events where projectiles travel at great velocity, the utility of the present invention is not limited to sporting environments. Similarly, the present invention is not limited to applications in which the chest is impacted by projectiles, but is also effective for reducing the likelihood and/or severity of injury from impacts to the chest caused by a variety of different means.

Figure 1:
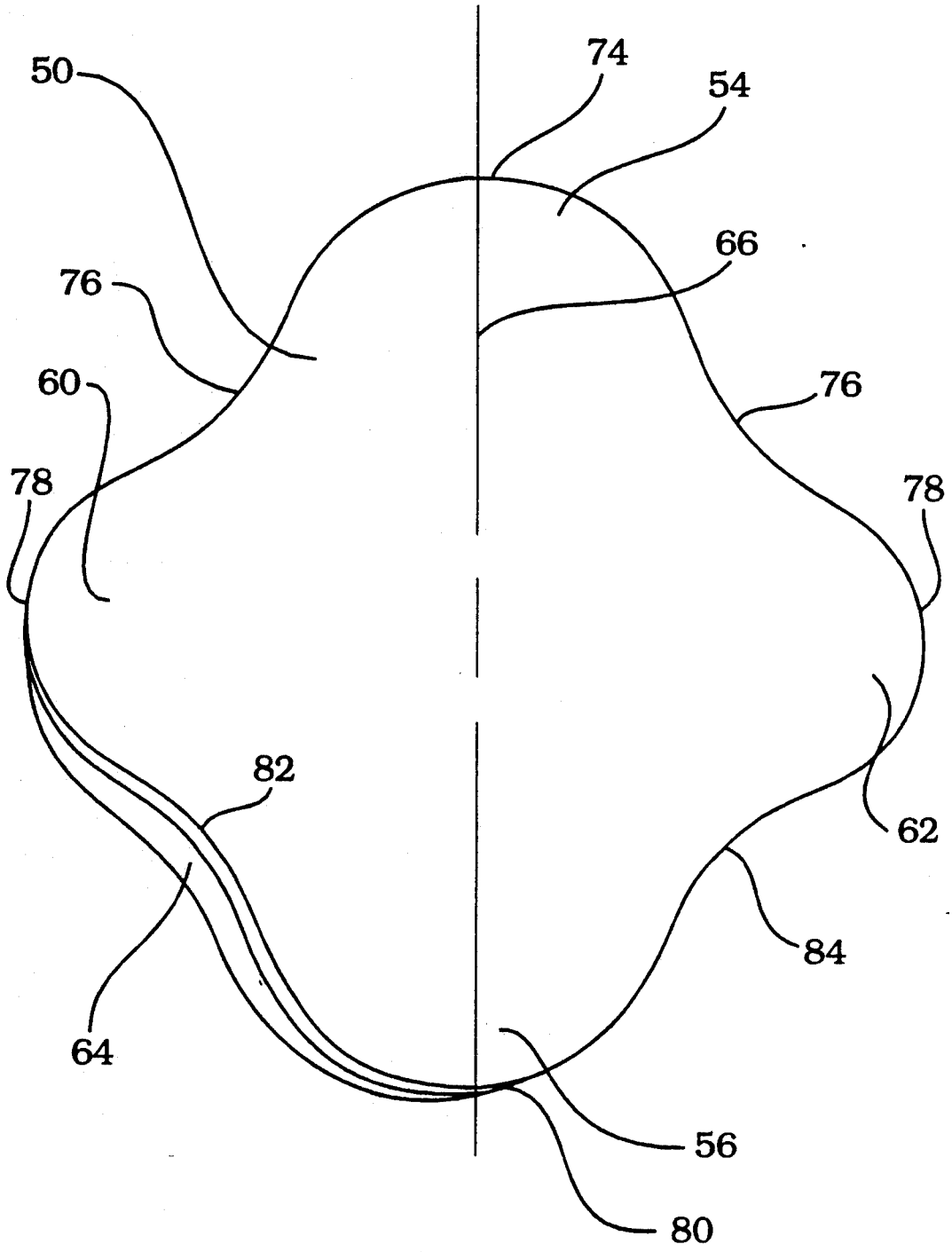
FIG. 1 is a front perspective view of one embodiment of the present invention.

Referring to FIG. 1, the protective device of the present invention includes a unitary body or plate 50, which in its first embodiment has a modified cross configuration. The vertical portion of the modified cross configuration includes an upper lobe 54 and a lower lobe 56. The horizontal portion includes a first and second symmetrical lateral lobes 60 and 62. The outline of the body or plate, including these lobes, enables the body or plate to bear evenly around its entire perimeter upon the wearer's chest to evenly distribute the force of an impact. Resilient foam padding 64 is attached to the back of the unitary body or plate 50 to aid in the absorption of impact force and increase comfort of the wearer.

Figure 2:
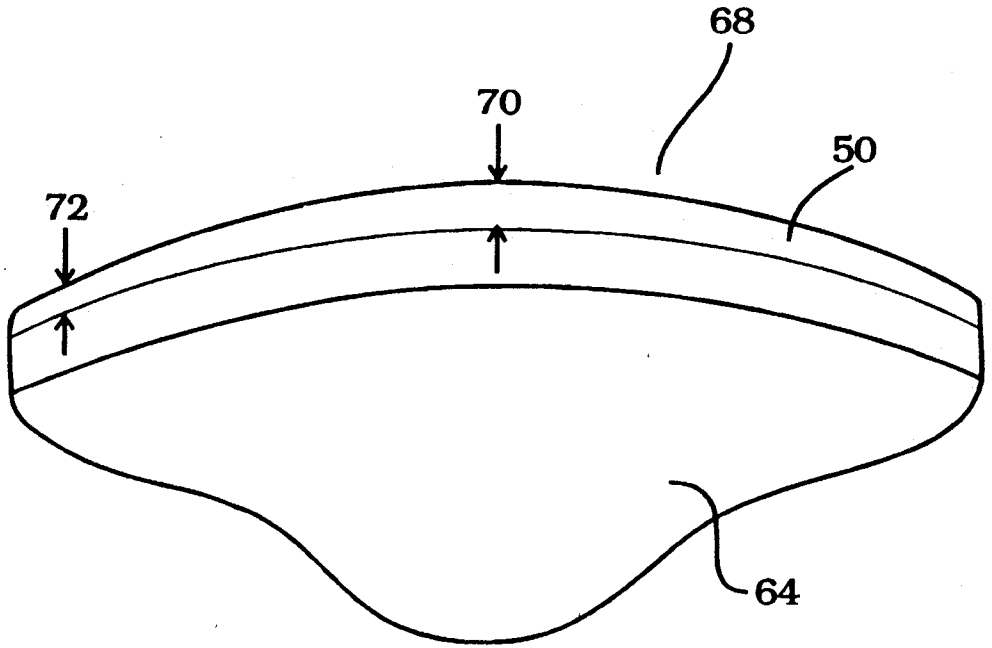
FIG. 2 is a cross-sectional view of the embodiment of the present invention illustrated in FIG. 1.

As illustrated in FIG. 2, which is a cross-sectional view taken through the centerline 66 in FIG. 1, the body or plate 50 is formed with a domed profile. The domed profile 68 (the body or plate is convex relative to the wearer's chest) serves several important functions. First, the domed profile 68 adds the dimension of depth to the contours of the unitary body, better enabling it to maintain proper positioning of the body or plate 50 with the 3-dimensional contours of the wearer's chest. Second, the domed profile 68 creates a protective bubble over the vital areas of the chest, initially transferring the force of an impact away from the vital areas to the perimeter of the body or plate 50, which rests upon the sturdier structures of the chest and abdomen. Third, the domed profile 68 tends to collapse or flatten under the force of an impact, thus dissipating and absorbing the energy and bringing more of the concave rear surface of the body or plate 50 into contact with the wearer's chest, thus distributing the force of an impact more evenly across the entire surface of the protected area.

Preferably, the radius of spherical curvature of the domed profile is sufficiently small that it allows the body or plate 50 (or the foam padding on the body or plate 50) to contact the chest of the wearer only at its perimeter edge so that the initial force of an impact is transferred away from the vital area directly behind the center of the body or plate 50 to this perimeter. However, the radius of the spherical curvature should also be large enough to allow the body or plate 50 to flex and deform under the force of the impact, absorbing and redistributing the impact force over a larger area.

The protective device of the present invention should be made of a material that is sufficiently stiff to resist the impact of a baseball, softball, hockey puck, or the like, at high speed. However, the material also should be flexible enough to allow the domed profile to controllably deform and to significantly reduce the speed of the ball, and to dissipate the impact force over the area of the body or plate 50. The material should also be selected to withstand repeated impacts without cracking, shattering or permanent distortion. Materials exhibiting a low modulus (a measure of the time required to return to its original configuration after flexing or distorting) are also preferable. Materials which exhibit these characteristics to varying degrees include: acetal (Delrin ®); Kydex ® (acrylic polyvinylchloride); acrylonitrile butadiene styrene (ABS); fluorocarbon resin (Teflon ®); glass fiber reinforced epoxy resin matrix (fiberglass); high density polyethylene; low density polyethylene; polyamide (Nylon ®); polycarbonate (Lexan ®); polyetherimide (Ultem ®); polypropylene; polystyrene; polyurethane; and various types of metals. Naturally, the thickness of the body or plate 50 must be determined based upon the characteristics of the material used.

It is also within the scope of the present invention that the body or plate may be formed with a laminar cross section of a layers of different materials. As one example, a core of metal may be bonded between two layers of high density polyethylene.

As illustrated in FIG. 2, in its preferred embodiment, the body or plate 50 is thicker toward the center or middle of the body or plate, with the thickness decreasing or tapering gradually towards the periphery 72. Alternatively, rather than gradually decreasing or tapering in thickness, the peripheral area 72 of the body or plate may be formed to a uniform lesser thickness than the larger thickness at the center or middle 70 of the body or plate, which may also be formed to a uniform thickness. Providing a larger thickness toward the center or middle of the body or plate serves to increase the stiffness and impact-resistance of the center of the body or plate while retaining the flexibility and impact-absorbing characteristics of the lobes.

Figure 3:
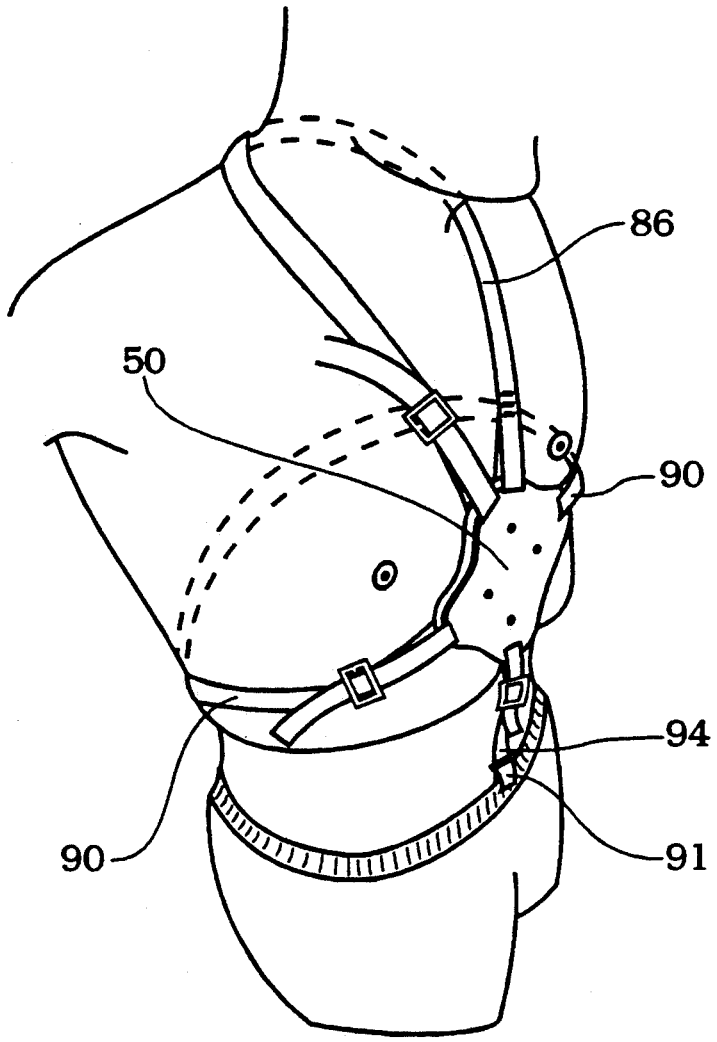
FIG. 3 is a side perspective view of the present invention as worn by a user.

FIG. 3 illustrates how the protective body or plate should be positioned on the user, and when viewed with reference to FIG. 1, better demonstrates the benefits of the shape of the body or plate. As shown in FIG. 3, when properly secured about the torso of the user, the upper lobe 54 extends upwardly along the lower and middle portion of the sternum, while the lower lobe covers the "solar plexus" and xiphoid process, and extends over the upper abdomen of the user. The first and second lateral lobes 60 and 62 extend along the lower portion of the rib cage of the user. While it is recognized that lobes could also be formed of alternate shapes, the projections are preferably formed as convex shaped lobes or peninsular projectins so as to reduce the likelihood of skin abrasions or skin punctures that might occur with sharp edges and corners, particularly in the event of an impact. The upper lobe 54 and lower lobe 56 are also preferably larger in size than the lateral lobes 60 and 62.

The upper lobe 54 preferably has a radius of curvature 74 sufficient to allow it to occupy approximately the entirety of the width of the groove between the pectoral muscles or breasts on either side of the sternum. Because the upper lobe 54 preferably does not extend excessively laterally over the pectoral muscles or breasts, the user's normal athletic movement is not unduly restricted, and discomfort is minimized.

Similarly, the contours of the junctures 76 between the upper lobe 54 and the first 60 and second 62 lateral lobes are preferably formed with a sufficiently large radius of curvature so that the contours generally follow the medial contours of the pectoral muscles. The junctures 76 should therefore be formed with a radius of curvature small enough so that the unitary body or plate 50 does not unduly interfere with the pectoral muscles or breasts during normal athletic activity. However, the radii of curvature should not be so small as to excessively reduce the effective protective area of the body or plate 50.

The contours 78 of the lateral lobes 60 and 62 should be of sufficiently large radius of curvature so as to approximately cover the natural concave groove which exists beneath the pectoral muscles, or breasts, and above the lower edge of the rib cage of the user. The radius of curvature of these lobes should be small enough so as not to protrude into the wearer's pectoral muscles, restricting movement or causing discomfort.

The contours 82 and 84 of the concave junctures which descend from the lateral lobes 60 and 62 to the lower lobe 56 should also be of a sufficiently large radius of curvature to follow the medial contours of the lower edge of the rib cage, thereby allowing the protective device to redistribute the impact force over the lower part of the rib cage during an impact. Preferably, the radii 82 and 84 are small enough so that the edges of the body or plate 50 do not rest upon the protruding edge of the rib cage at a single point on either side. However, the radii of curvature should not be so small as to excessively reduce the effective protective area of the body or plate 50.

The contour 80 of the lower lobe 56 should be of a sufficiently large radius of curvature to cover the "solar plexus" and the xiphoid process and to extend over the upper abdomen of the user.

Figure 4:
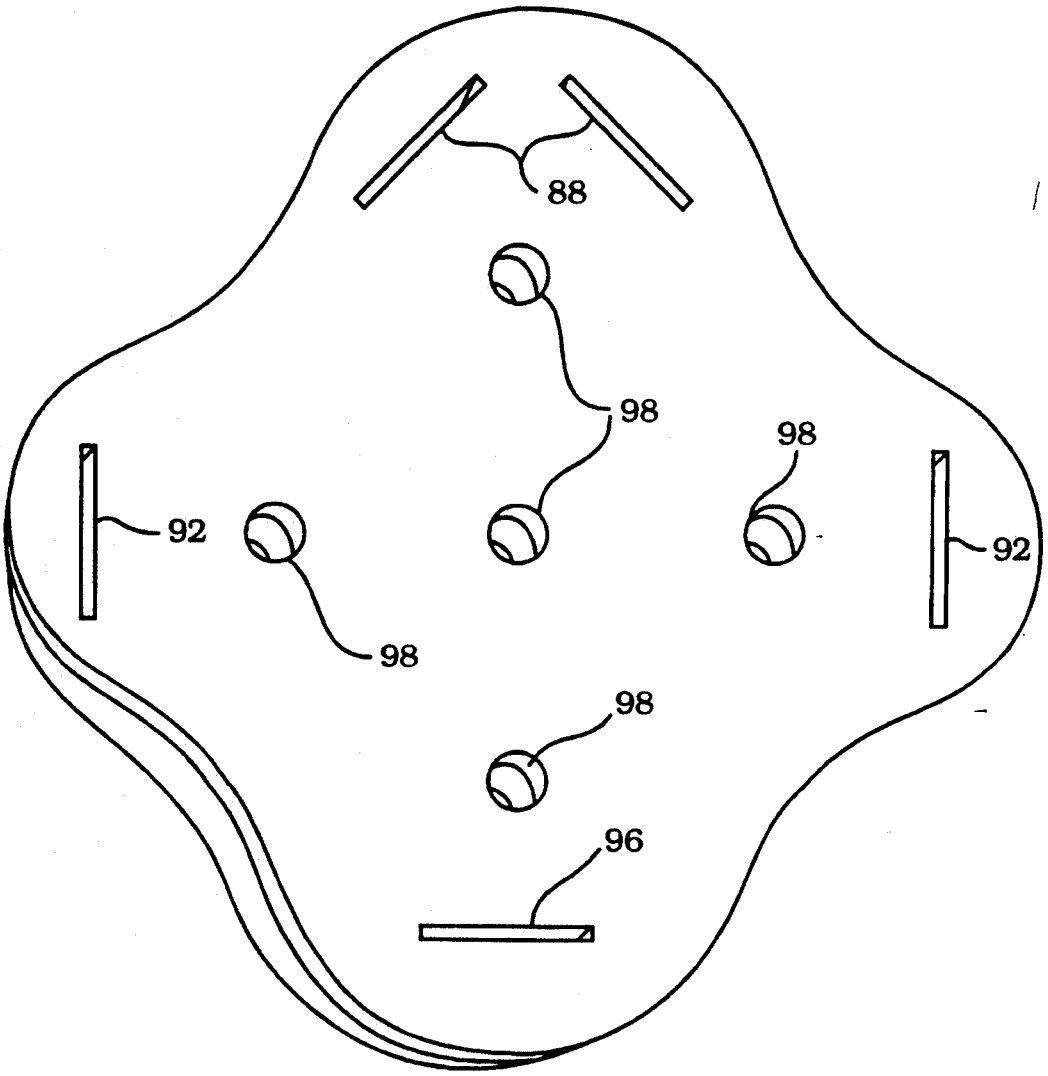
FIG. 4 is a front perspective view of the present invention.

As illustrated in FIGS. 3 and 4, in the preferred embodiment, the protective body or plate 50 is maintained in its proper position upon the wearer's chest by three adjustable lengths of elastic webbing. The first length of webbing 86 is attached to the upper lobe through two slots 88 symmetrically located near the perimeter edge, at slight angles. In use, the first length of webbing extends from one of the slots on the upper lobe of the body or plate 50 up and around the back of the neck of the wearer, then extends forward and back down to the opposite slot in the upper lobe of the body or plate 50, to establish and maintain proper positioning of the body or plate 50 over the vital area, both vertically and laterally. This first length of webbing 86 may be permanently attached to the body or plate 50 at one end by sewing, rivets, or some other means, and adjustably attached to the opposite slot by some other structure, such as a sliding buckle. It may also be adjustably attached at both ends of its length through the slots 88, allowing for adjustment from either side. Alternately, the first length 86 may be disconnected and reconnected at some point along its length through the use of a separable buckle or clip to facilitate ingress and egress of the wearer into and out of the protective equipment.

The second length of webbing 90 extends between a slot 92 located near the edge of each of the lateral lobes 60 and 62 and is designed to extend about or encircle the wearer's torso from one lateral lobe of the body or plate 50 to the opposite lateral lobe. The second length of webbing 90 may be permanently attached to the body or plate 50 at one end by sewing, rivets, or other non-adjustable means, and attached to the opposite slot by adjustable means, such as a sliding buckle. It may also be attached by adjustable means at both ends of its length through the slots, allowing for adjustment from either side. Alternately, it may be disconnected and reconnected at some point along its length through the use of a separable buckle or clip to facilitate ingress and egress of the wearer into and out of the protective equipment.

The third length of webbing 94 is attached at its upper end to the lower lobe 56 of the body or plate 50, through a slot 96 near the perimeter edge of the body or plate 50, and is designed to prevent the body or plate 50 from becoming mispositioned and climbing up the wearer's chest during athletic activity. The upper end of this third length of webbing may be permanently attached to the body or plate 50 by sewing, riveting, or other suitable means, or it may be attached by adjustable means, such as a slide buckle. The lower end of the third length of webbing is attached to a buckle or clip which may be quickly and easily attached to and detached from the wearer's belt, trouser waistband, underwear, or athletic supporter. The buckle should attach securely to the wearer's garment and, ideally, not require any modification to the garment. A clamp-type buckle 91, such as that commonly found on trouser suspenders, would be sufficient. This buckle may be fixedly attached to the end of the elastic webbing (which would necessitate the opposite end of the webbing being attached by adjustable means to the body or plate 50), or it may be attached to the webbing by adjustable means (which would allow for the opposite end of the webbing to be fixedly attached to the body or plate 50).

Other methods of securing the protective body or plate to the torso of the user are also envisioned as a part of this invention. For example, other configurations of elastic webbing may be used. Alternatively, a shirt or jacket may be provided with a closable pocket into which the protective plate or body may be placed such that the protective plate or body is correctly positioned over the chest of the user when the shirt or jacket is worn by the user.

In addition to demonstrating the slots 88, 92 and 96, FIG. 4 also illustrates a series of ventilation holes 98 that may also be provided to reduce the thermal discomfort associated with wearing the device. Although the number and location of such ventilation holes 98 are somewhat discretionary, care must be taken to assure that the number and location do not weaken the body or plate and detract from its ability to absorb and redistribute the impact force.

When secured to the torso in the manner described above, the likelihood and/or severity of injury resulting from the impact of a projectile such as a baseball, softball, hockey puck or the like striking the lower part of the chest should be lessened because the impact force is redistributed to a larger area of the sternum and the lower rib cage of the wearer.

Figure 5:
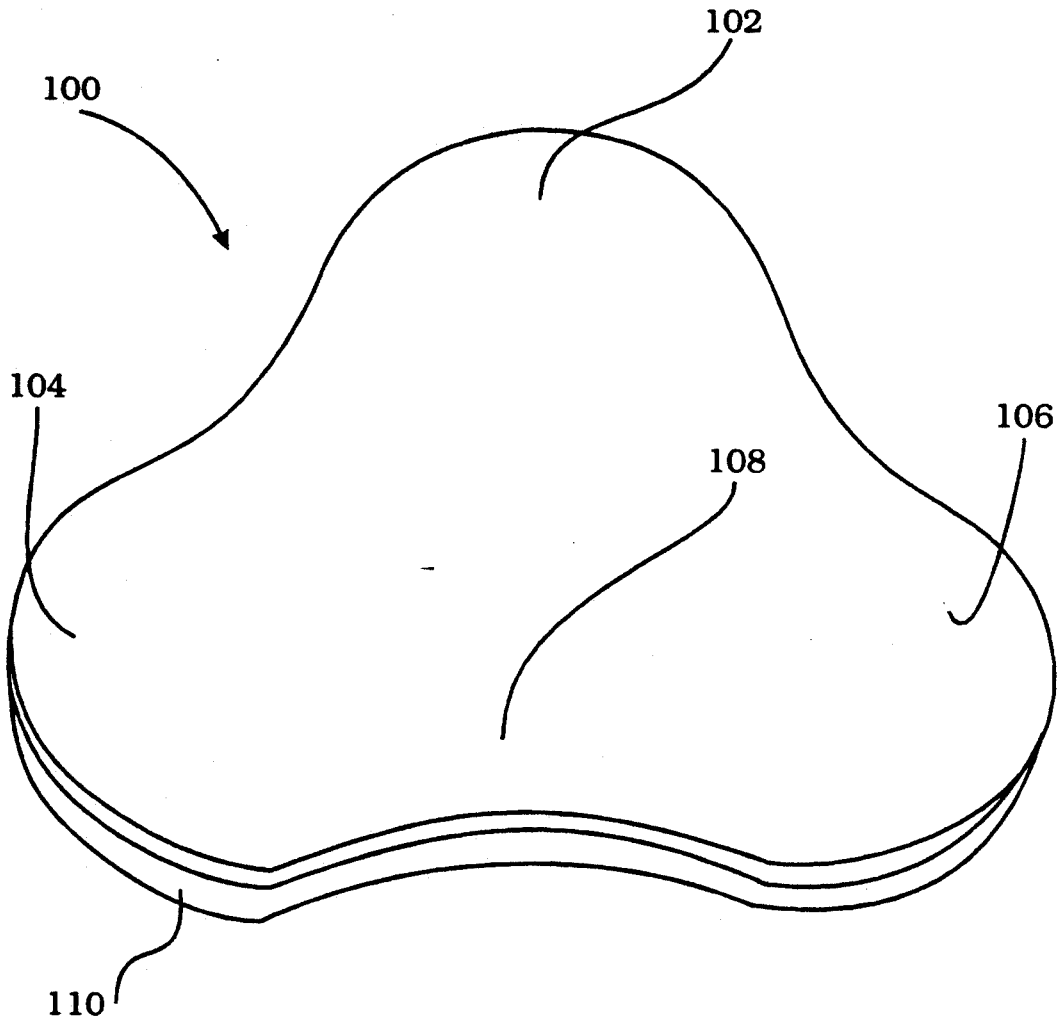
FIG. 5 is a front perspective view of an alternate embodiment of the present invention.

FIG. 5 illustrates an alternative embodiment of the present invention in which the unitary body or plate 100 includes an upper lobe 102 and lateral lobes 104 and 106, but where the lower lobe 56 illustrated in FIG. 1 has been eliminated. As with the preferred embodiment, this alternative embodiment also includes a domed profile 108 and resilient foam padding 110.

It must also be emphasized that the utility of the present invention is not limited to the specific sports of baseball, softball and hockey. Rather, it is recognized that the present invention is equally useful in a variety of other athletic events where a participant is likely to suffer chest injury from an impact, and thus these itemized sports are for exemplary and illustrative purposes only.

I claim:

1. A protective device for the center of the chest of a human user, including the sternum, the solar plexus and the right and left lower portions of the rib cage, comprising:

a unitary body constructed in a modified cross configuration so as to cover essentially the center portion of the chest of the user, wherein the unitary body includes;

a vertical portion which includes an upper lobe and a lower lobe, wherein the upper lobe extends vertically along the sternum and wherein the lower lobe extends over the solar plexus when positioned on the user;

a horizontal portion integrally connected to the vertical portion, wherein the horizontal portion includes a right lobe and a left lobe, wherein the right and left lobes respectively extend along the right and left lower portion of the rib cage adjacent to the sternum when positioned on the user; and a peripheral edge running about the entire periphery of the unitary body, and wherein the unitary body is formed with a domed profile so that the peripheral edge of the unitary body contacts the natural curvature of the body of the user.

2. A protective device for the chest according to claim 1, wherein a portion of the peripheral edge extending between the upper lobe and the right lobe, and the portion of the peripheral edge extending between the upper lobe and the left lobe are concavely formed in order to follow the medial and lower contours of the pectoral muscles of the user.

3. A protective device for the chest according to claim 1, further comprising:

a first length of webbing attachable to the upper lobe for securing the unitary body around the neck of the user; and a second length of webbing attachable to the right and left lobes for securing the unitary body around the torso of the user.

4. A protective device for the chest according to claim 1, further comprising:

a first length of webbing attachable to the upper lobe for securing the unitary body around the neck of the user;

a second length of webbing attachable to the right and left lobes for securing the unitary body around the torso of the user; and a third length of webbing having a first and second end and attachable at the first end to the lower lobe and attachable at the second end to a garment worn at the waist of the user.

5. A protective device for the chest according to claim 1, wherein the unitary body is formed of at least one material selected from the group consisting of:

acetal, acrylic polyvinylchloride, acrylonitrile butadiene styrene, fluorocarbon resin, glass fiber reinforced epoxy resin matrix, high density polyethylene, low density polyethylene, polyamide, polycarbonate, polyetherimide, polypropylene, polystyrene, polyurethane, and metal.

6. A protective device for the chest according to claim 1, wherein the unitary body is formed with a cross-sectional thickness, and wherein the cross-sectional thickness of the unitary body decreases towards the peripheral edge.

7. A protective device for the chest according to claim 6, wherein the cross-sectional thickness of the unitary body decreases gradually towards the peripheral edge.

8. A protective device for the chest according to claim 6, thickness, and wherein the cross-sectional thickness of the unitary body decreases incrementally towards the peripheral edge.

9. A protective device for the chest of a human user, including the sternum, the solar plexus and the right and left lower portions of the rib cage, comprising:

a main body formed of an impact-resistant and impact-distributing material to be placed over the lower portion of the sternum of the user;

a first peninsular projection integrally formed with and extending upward from the main body along the sternum when positioned on the user; and second and third peninsular projections integrally formed with and extending from the main body in essentially opposite directions and essentially perpendicular to the direction of the first peninsular projection so as to extend along the lower portion of the rib cage when positioned on the user;

a fourth peninsular projection integrally formed with the main body and extending downward from the main body in essentially the opposite direction as the first peninsular projection so as to extend over the solar plexus when positioned on the user.

10. A protective device for the chest according to claim 9, wherein the main body and the peninsular projections are formed with a domed profile.

11. A protective device for the chest according to claim 9, further comprising means for securing the main body and peninsular projections to the chest of the user.

* * * * *